US010612270B1

(12) United States Patent
Wu

(10) Patent No.: US 10,612,270 B1
(45) Date of Patent: Apr. 7, 2020

(54) DUST COVER AND LOCK ASSEMBLY WITH THE SAME

(71) Applicant: SUO KE AN INDUSTRIES CO., LTD., New Taipei (TW)

(72) Inventor: Kun-Yu Wu, New Taipei (TW)

(73) Assignee: SUO KE AN INDUSTRIES CO., LTD., New Taipei (TW)

( * ) Notice: Subject to any disclaimer, the term of this patent is extended or adjusted under 35 U.S.C. 154(b) by 0 days.

(21) Appl. No.: 16/411,502

(22) Filed: May 14, 2019

(51) Int. Cl.
*E05B 17/18* (2006.01)
*E05B 17/14* (2006.01)

(52) U.S. Cl.
CPC ..... *E05B 17/14* (2013.01); *E05B 17/18* (2013.01); *E05B 17/183* (2013.01); *E05B 17/188* (2013.01)

(58) Field of Classification Search
CPC ..... E05B 17/14; E05B 17/142; E05B 17/18; E05B 17/183; E05B 17/188
See application file for complete search history.

(56) References Cited

U.S. PATENT DOCUMENTS 3,740,981 A * 6/1973 Patriquin ..... F16B 37/14 70/455
4,154,072 A * 5/1979 Flaschar ..... E05B 17/183 70/455
4,706,841 A * 11/1987 Grajek ..... E05B 17/14 220/375
4,825,673 A * 5/1989 Drake ..... E05B 17/14 70/455
5,241,846 A * 9/1993 Hoke ..... E05B 17/183 70/423
6,055,832 A * 5/2000 Wyers ..... E05B 17/183 70/18
6,575,000 B1 * 6/2003 Li ..... B60D 1/60 280/507
7,698,915 B2 * 4/2010 Wyers ..... B60D 1/065 70/14

* cited by examiner

*Primary Examiner* — Christopher J Boswell
(74) *Attorney, Agent, or Firm* — Muncy, Geissler, Olds & Lowe, P.C.

(57) ABSTRACT

A lock assembly has a lock and a dust cover. The dust cover has a cover body, a connecting portion and a mounting ring. An annular insertion wall protrudes from a surface of the cover plate. Two opposite ends of the connecting portion are connected to the cover body and the mounting ring respectively. The lock has a lock cylinder. A keyhole is formed in one end of the lock cylinder. The lock cylinder has a door abutting portion and an annular mounting groove. The door abutting portion abuts against a door when the lock is mounted on the door. The mounting ring of the dust cover is rotatably mounted around the annular mounting groove. The annular insertion wall can be mounted in and engages with the keyhole. The rotatable dust cover makes the installation, use, and maintenance of the dust cover more convenient.

14 Claims, 11 Drawing Sheets

DUST COVER AND LOCK ASSEMBLY WITH THE SAME

BACKGROUND OF THE INVENTION

1. Field of the Invention

The present invention relates to a dust cover for a lock, especially to a dust cover that is designed for a tubular lock.

2. Description of the Prior Arts

A conventional lock must have a keyhole formed in a front face of a lock cylinder, and therefore dirt, dust, moisture and other foreign objects can easily enter the lock through the keyhole and affect both the operation and the service life of the lock. A hollow tubular lock is especially vulnerable to intrusion of foreign objects due to a greater opening area of the keyhole. In order to solve this problem, dust covers have been developed to prevent foreign objects from entering the lock by sealing the keyhole. To be more specific, the conventional dust covers can be classified into the following two types.

First, a metal dust cover 91 (with reference to FIGS. 9 and 10): a mounting ring 911 of the metal dust cover 91 is clamped between a door 92 and a lock cylinder 93 of a lock. A cover body 912 of the metal dust cover 91 is pivotally mounted on the mounting ring 911. A torsion spring 913 forces the cover body 912 to rotate towards the lock cylinder 93 to ensure the keyhole is reliably covered and sealed by the cover body 912. However, unlocking a lock with the metal dust cover 91 requires both hands of a user, because one hand of the user needs to hold the cover body 912 open to reveal the keyhole before the lock can be operated by the other hand of the user. The metal dust cover 91 is therefore not convenient because the user cannot operate using one hand.

Second, a rubber dust cover 95 (with reference to FIG. 11): a mounting ring 951 of the rubber dust cover 95 is clamped between a door and a lock cylinder 93 in a way similar to the metal dust cover. A cover body 952 and the mounting ring 951 are connected to the opposite ends of an elongated connecting portion 953 respectively. However, due to the lower strength of the rubber, the thickness of the mounting ring 951 needs to be greater to compensate for the lower strength, which causes the lock cylinder 93 to protrude significantly from a surface of the door after a rubber dust cover 95 is mounted to the lock, and therefore the appearance of the product is affected.

Moreover, the lock cylinder 93 is firmly fixed on the door through the clamping between the lock cylinder 93 and a nut, and therefore the door and the mounting ring 951 between the lock cylinder 93 and the nut are pressed against each other, which makes the relative rotation between the rubber dust cover 95 and the lock cylinder 93 impossible. As a result, the rubber dust cover 95 must be rotated to a proper mounting angle during installation, otherwise the cover body 952 may interfere with the door frame when the cover body 952 is separated from the front face of the lock cylinder 93 and extends towards the door frame, which affects the operation of the door. Moreover, the lock cylinder 93 needs to be removed from the door when replacing a broken rubber dust cover 95, which makes the maintenance complicated.

To overcome the shortcomings, the present invention provides a dust cover and a lock assembly with the same to mitigate or obviate the aforementioned problems.

SUMMARY OF THE INVENTION

The main objective of the present invention is to provide a dust cover and a lock assembly with the same for ease of use and ease of maintenance.

A lock assembly mounted through a door comprises a lock and a dust cover. The lock comprises a lock cylinder and a nut. The lock cylinder is mounted through the door. A keyhole is formed in one end of the lock cylinder. An annular mounting groove is formed around an outer surface of the lock cylinder. A door abutting portion protrudes from the outer surface of the lock cylinder. The annular mounting groove is located between an opening of the keyhole and the door abutting portion. The nut is mounted around and screwed into the lock cylinder. A door mounting groove is formed between the door abutting portion and the nut. The door mounting groove and the annular mounting groove are located on two opposite sides of the door abutting portion respectively. The door is engaged in the door mounting groove and clamped between the door abutting portion and the nut. The dust cover is made of plastic and comprises a cover body, a connecting portion and a mounting ring. The cover body comprises a cover plate and an annular insertion wall. The annular insertion wall protrudes from one of two surfaces of the cover plate. The connection portion is elongated and bendable. One of two ends of the connecting portion is connected to the cover plate. The connecting portion comprises a first bending recess. The first bending recess is formed in a surface of the connecting portion and extends to two opposite sides of the connecting portion. The mounting ring is connected to the other end of the connecting portion. The mounting ring of the dust cover is rotatably mounted around the annular mounting groove of the lock cylinder. The annular insertion wall is selectively mounted in and engages with the keyhole. One of the two surfaces of the cover plate is attached to the lock cylinder when the annular insertion wall is mounted in and engages with the keyhole.

The advantage of the present invention is that the lock cylinder has the annular mounting groove and the door abutting portion. When the lock cylinder is mounted in the door, the door abutting portion abuts against the door, meanwhile the mounting ring of the plastic dust cover is annularly mounted in the annular mounting groove, such that the mounting ring does not abut against the door, and is able to rotate freely in the annular mounting ring. Therefore, the present invention has the following advantages.

First, the lock assembly is fixed on the door by the clamping between the door abutting portion of the lock cylinder and a nut, so the mounting ring is no longer clamped between the door and the lock cylinder. As a result, the mounting ring can be removed from or mounted into the mounting groove of the lock cylinder with ease and therefore the lock cylinder does not have to be removed when replacing a broken dust cover, which is time saving.

Second, the dust cover can rotate relative to the lock cylinder, such that after installing the dust cover, the user can still rotate the dust cover to prevent interference between the cover body and the door frame, which makes the installation and use of the dust cover more convenient.

Third, the present invention is made with plastic, which has a higher strength than rubber, and therefore a thickness of the dust cover in accordance with the present invention can be thinner, such that the length of the lock cylinder can be reduced, and a distance which the lock cylinder protrudes from the door can be reduced, and as a result the appearance of the lock assembly is improved.

Fourth, a cover body of a conventional dust cover seals the keyhole by covering the exterior surfaces of the lock cylinder, and therefore the lock cylinder needs to protrude from the door long enough in order for the cover body to cover and engage properly with the lock cylinder. On the other hand, a cover body in accordance with the present invention seals the lock by inserting the annular insertion wall into the keyhole, such that the dust cover does not require the lock cylinder to protrude from the door, and therefore the protrusion length of the lock cylinder from the door can be further reduced, which improves the appearance of the lock assembly. The surface area of the cover body can also be reduced to be a little greater than the opening area of the keyhole, which saves cost.

Other objectives, advantages and novel features of the invention will become more apparent from the following detailed description when taken in conjunction with the accompanying drawings.

DETAILED DESCRIPTION OF THE PREFERRED EMBODIMENTS

With reference to FIGS. 1 to 4, a dust cover in accordance with the present invention comprises a cover body 10, a connecting portion 20, and a mounting ring 40. In a preferred embodiment, the dust cover further comprises a holding tab 30. The dust cover is made of plastic, and in a preferred embodiment, the dust cover is made of, but not limited to, high strength engineering plastic to reduce the product size and to improve service life.

Figure 2:
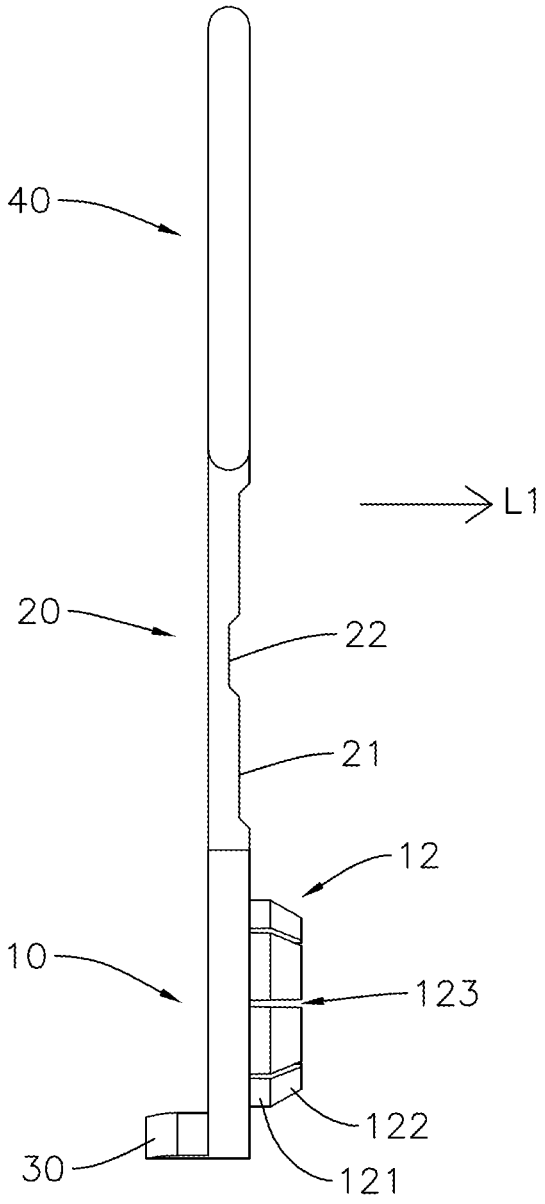
FIG. 2 is a side view of the dust cover in FIG. 1.

The cover body 10 comprises a cover plate 11 and an annular insertion wall 12. The annular insertion wall 12 protrudes from one of two surfaces of the cover plate 11. A direction in which the annular insertion wall 12 protrudes from the cover plate 11 is defined as a protruding direction L1 (as shown in FIG. 2). In a preferred embodiment, the annular insertion wall 12 comprises an engaging portion 121 and a guiding portion 122. The engaging portion 121 is formed on the cover plate 11. The guiding portion 122 is formed on an end of the engaging portion 121. The thickness of the guiding portion 122 gradually decreases towards a direction away from the cover plate 11, such that the thinner tip of guiding portion 122 can be utilized for helping the annular insertion wall 12 to enter the opening of a keyhole of a lock, and then the thicker engaging portion 121 firmly engages with the keyhole. However, the annular insertion wall 12 is not limited to comprising an engaging portion 121 and a guiding portion 122, as the annular insertion wall 12 can also be an annular wall having uniform thickness. In a preferred embodiment, multiple separation slots 123 are formed in a top of the annular insertion wall 12. The separation slots 123 extend from the top of the annular insertion wall 12 (outer end of the guiding portion 122) towards the cover plate 11. The separation slots 123 are annularly disposed apart from each other, such that it is easier for the annular insertion wall 12 to deform, and through the deformation it is easier for the annular insertion wall 12 to insert into the keyhole.

The connecting portion 20 is elongated and bendable. One of two ends of the connecting portion 20 is connected to the cover plate 11. A first bending recess 21 is formed in a surface of the connecting portion 20. The first bending recess 21 extends to two opposite sides of the connecting portion 20. In a preferred embodiment, an opening of the first bending recess 21 of the connecting portion 20 is open towards a direction in which the annular insertion wall 12 protrudes from the cover plate when the connecting portion 20 is straight without bending. In a preferred embodiment, there is, but not limited to, a second bending recess 22 formed in a bottom of the first bending recess 21. The second bending recess 22 extends to the two opposite sides of the connecting portion 20, and an area of the second bending recess 22 is smaller than an area of the first bending recess 21. The first bending recess 21 and the second bending recess 22 can be formed in other positions, as long as the first bending recess 21 and the second bending recess 22 make the connecting portion 20 more bendable, which means that when the user pushes the cover body 10 along the protruding direction L1, the connecting portion 20 easily bends. In another preferred embodiment, the first bending recess 21 and the second bending recess 22 can be formed in two opposite surfaces of the connecting portion 20 respectively.

The holding tab 30 protrudes from the other surface of the cover plate 11, meaning that the holding tab 30 and the annular insertion wall 12 are located on the two surfaces of the cover plate 11 respectively. In a preferred embodiment, the holding tab 30 is located on, but not limited to, a periphery of the cover plate 11, and meanwhile the holding tab 30 and the connecting portion 20 are located on two opposite sides of the cover plate 11 respectively, such that when the annular insertion wall 12 of the cover body 10 is inserted in the keyhole of the lock, the user can easily pull out the cover body 10 by holding the holding tab 30. In another preferred embodiment, the holding tab 30 protruding from the other surface of the cover plate 11 can be located in the center of the cover plate 11. Moreover, the cover body 10 can be removed from the keyhole by other means, such as by changing the shape of the cover plate 11. The cover body 10 does not have to have the holding tab 30.

The mounting ring 40 is connected to the other end of the connecting portion 20, meaning that the mounting ring 40 and the cover body 10 are connected to two ends of the connecting portion 20 respectively. The dust cover can be connected to the lock cylinder by mounting the mounting ring 40 around the lock cylinder, and in this case the dust cover stay connected to the lock cylinder even if the dust cover is removed from the keyhole, which reduces the risk of losing the dust cover.

Figure 5:
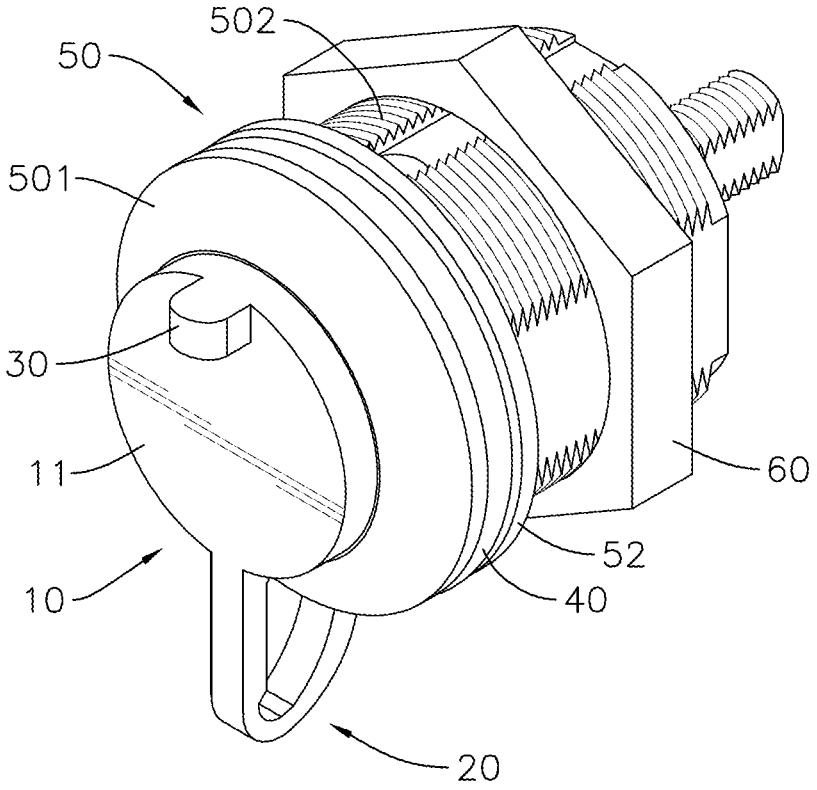
FIG. 5 is a perspective view of a first embodiment of a lock assembly in accordance with the present invention.
Figure 6:
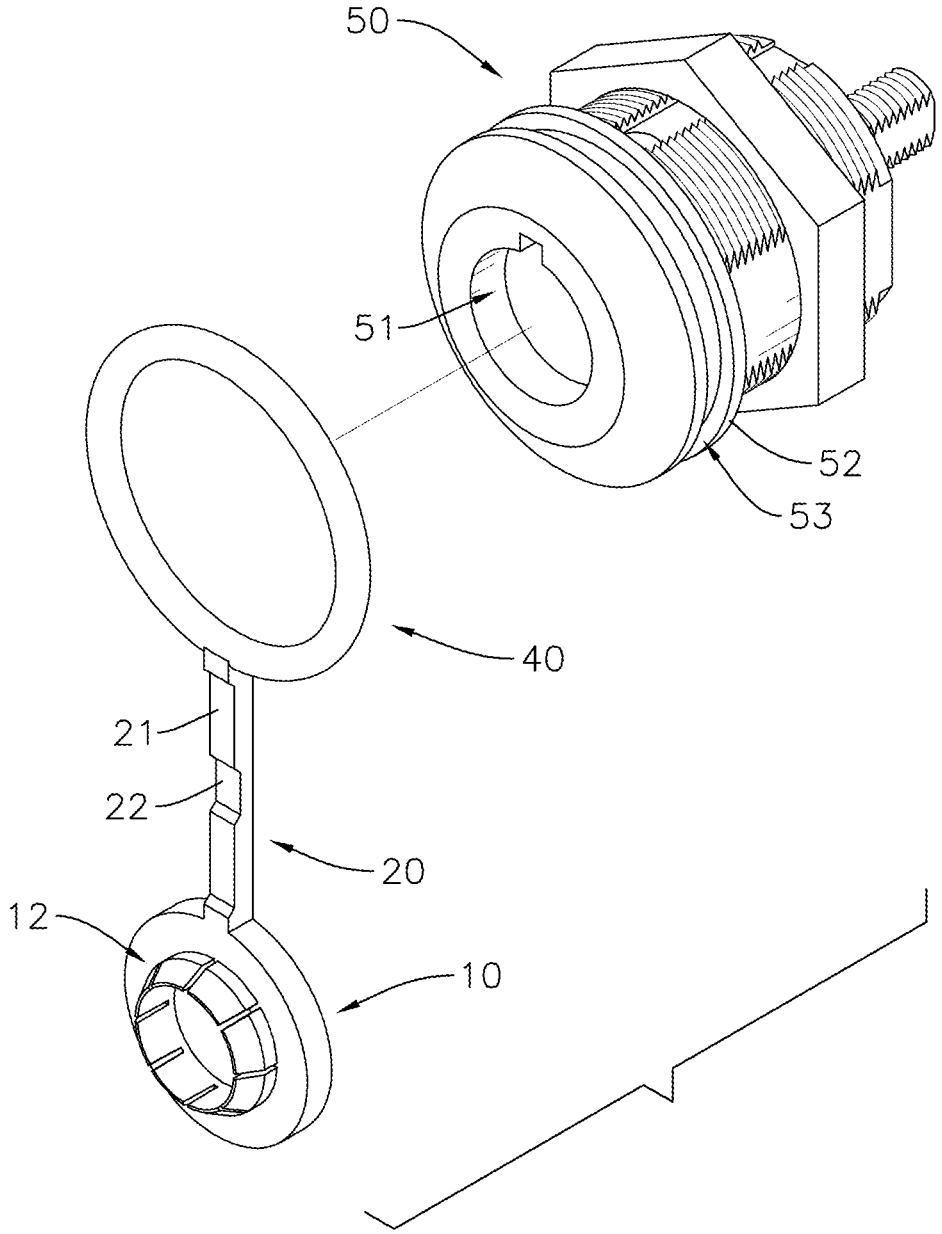
FIG. 6 is a rear view of the lock assembly in FIG. 5.
Figure 8:
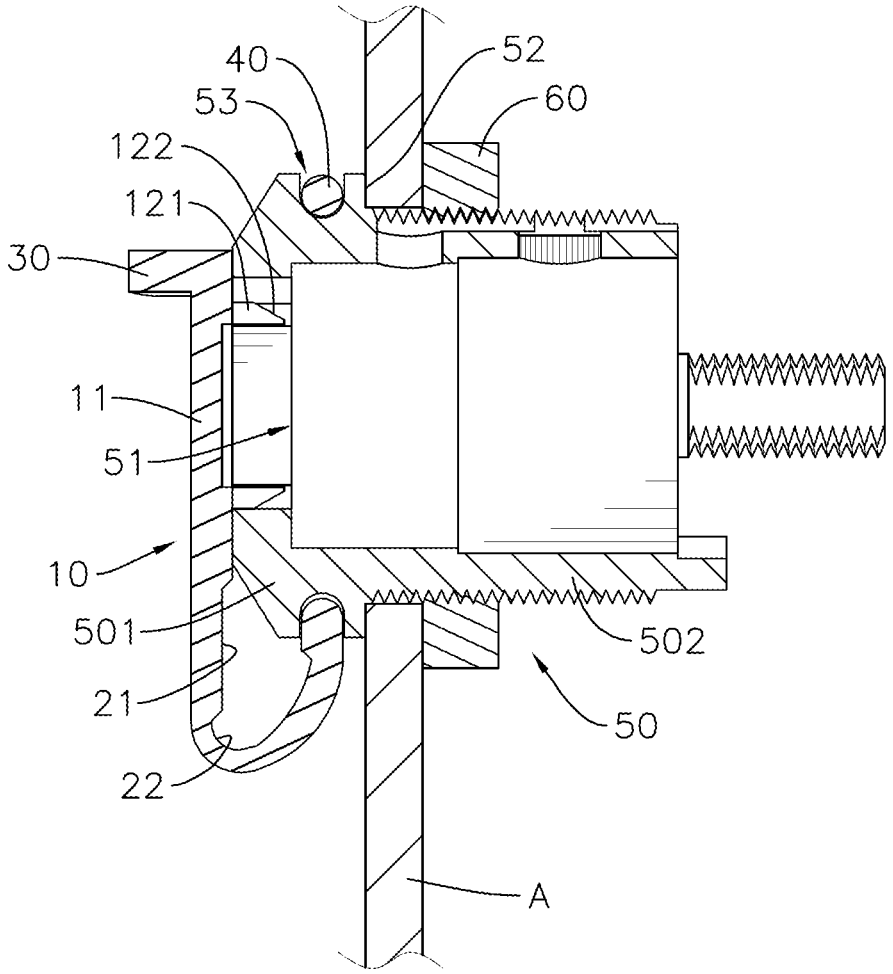
FIG. 8 is a sectional view of the lock assembly in FIG. 5.
Figure 9:
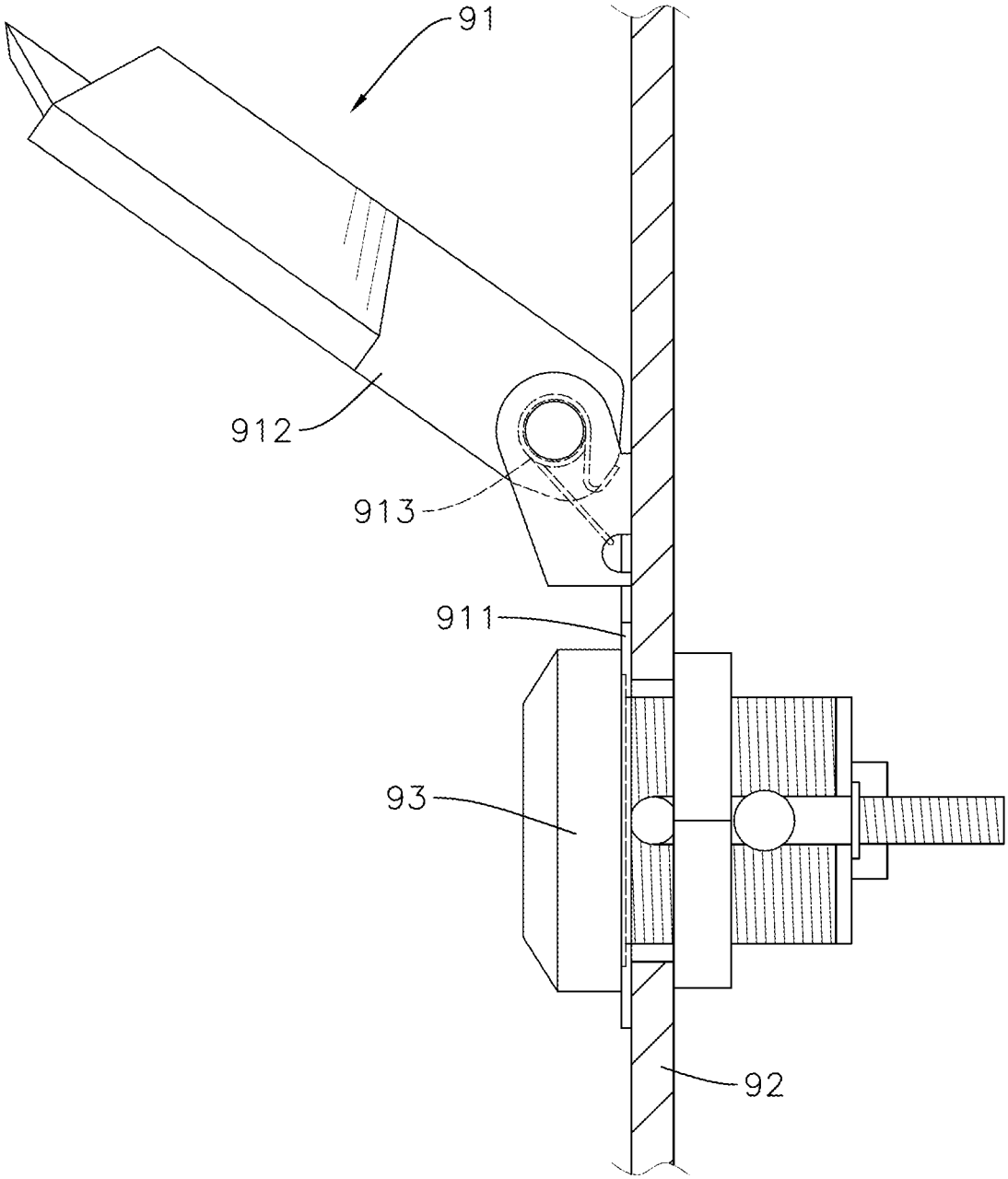
FIG.9 PRIOR ART
FIGS. 9 and 10 are side views of a conventional lock assembly with an integral metal dust cover shown in different statuses.
Figure 10:
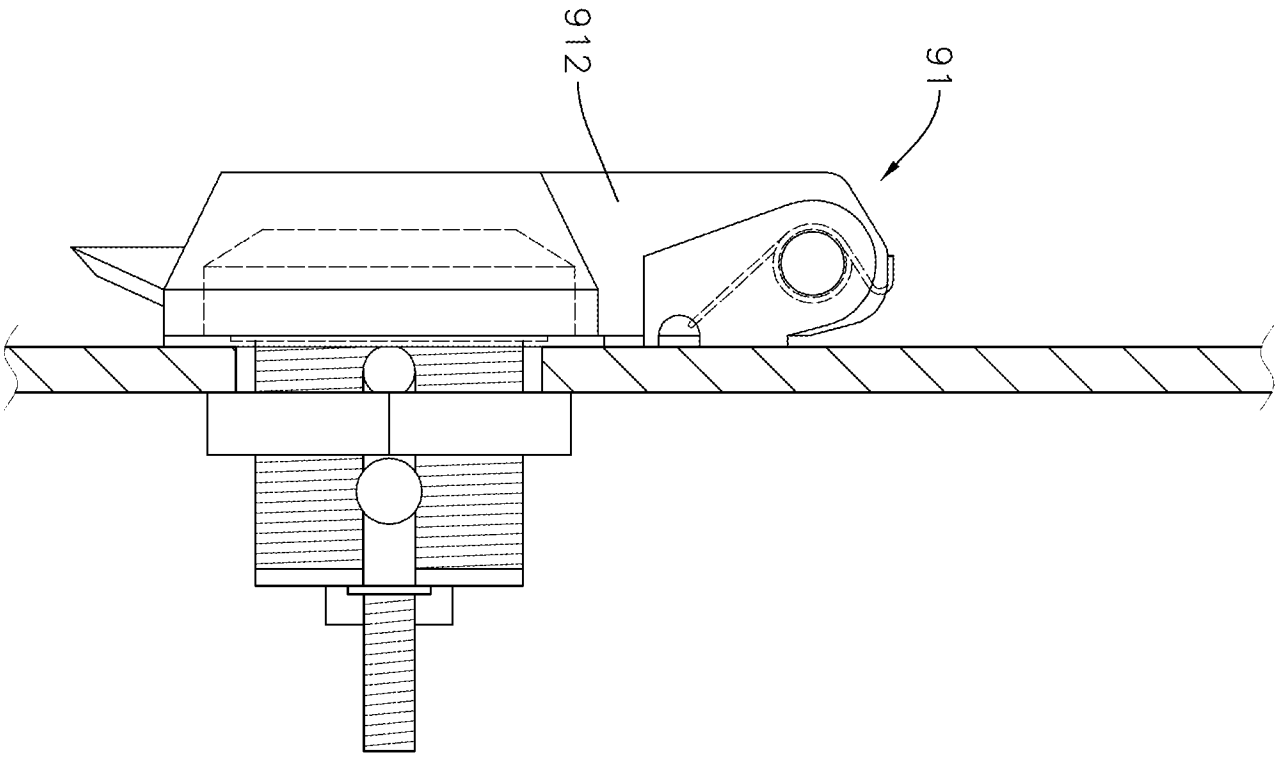
FIG. 10 PRIOR ART
Figure 11:
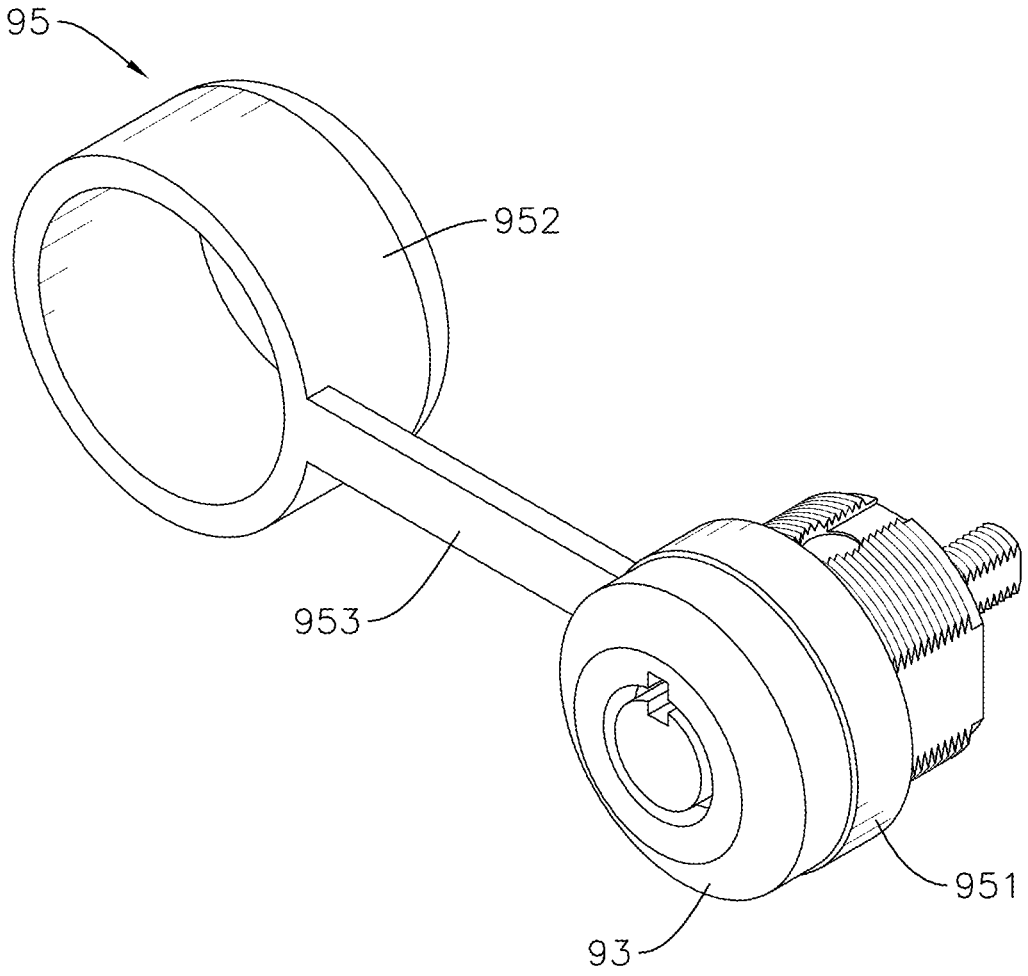
FIG. 11 PRIOR ART
FIG. 11 is a perspective view of a conventional rubber dust cover mounted in a lock.

With reference to FIGS. 5, 6 and 8, a lock assembly in accordance with the present invention comprises a lock and a dust cover. In a preferred embodiment, the structure of the dust cover is identical to that of the aforementioned dust cover, and thus the details are herein omitted for conciseness.

Figure 7:
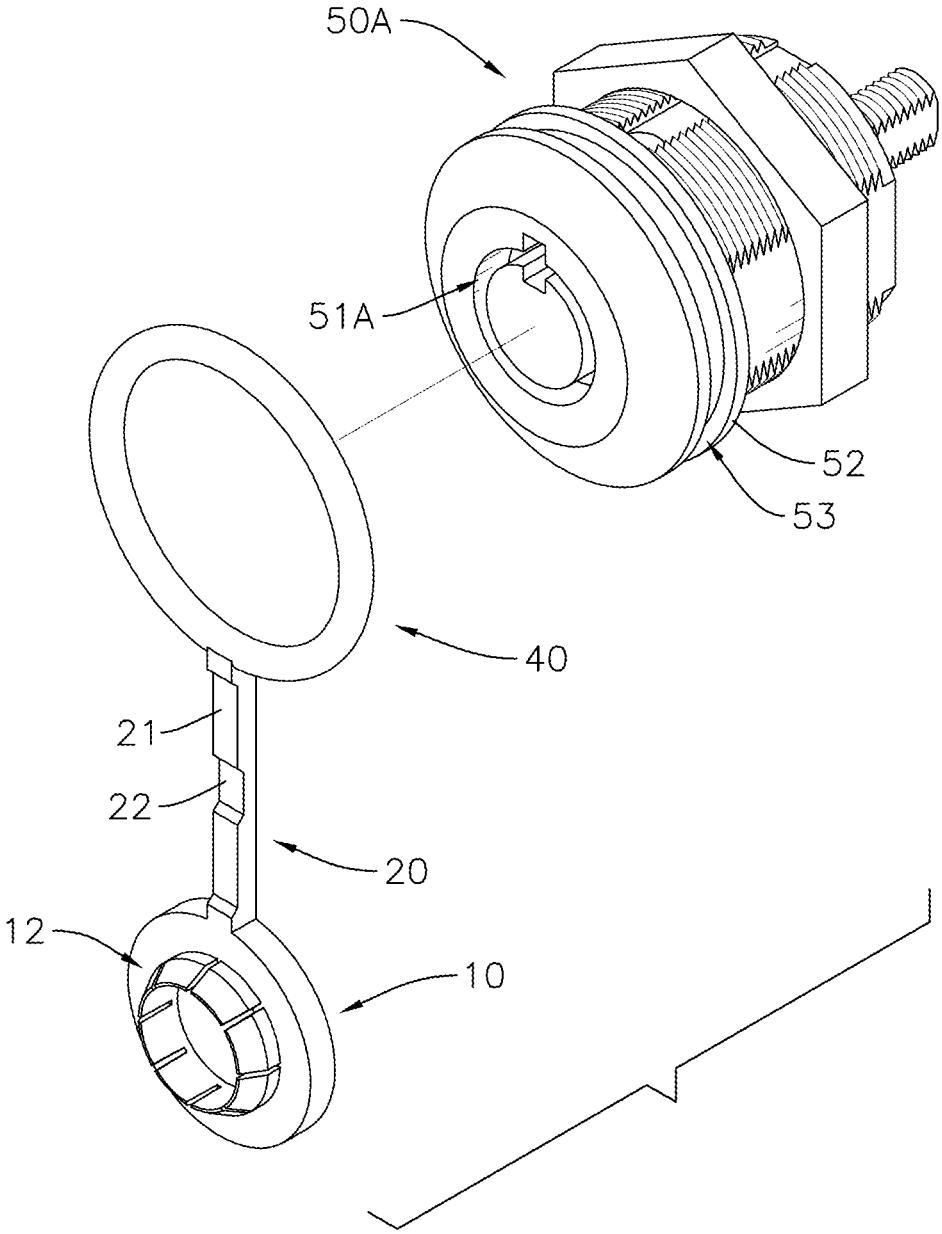
FIG. 7 is a perspective view of a second embodiment of a lock assembly in accordance with the present invention.

The lock comprises a lock cylinder 50. The lock cylinder 50 has a keyhole 51, a door abutting portion 52 and an annular mounting groove 53. The keyhole 51 is formed in one end of the lock cylinder 50. In a preferred embodiment, the lock cylinder 50 is, but not limited to, a cylindrical tubular lock, and to be more specific, the lock cylinder 50 is a hollow tubular lock. Because the opening area of the keyhole 51 of a hollow tubular lock (as shown in FIG. 6) is greater than the opening area of the keyhole 51A of a standard tubular lock (as shown in FIG. 7), it is more necessary to equip the hollow tubular lock with the dust cover to prevent foreign objects from entering the lock cylinder 50 through the keyhole 51. The present invention can also include a lock cylinder of any other type.

The door abutting portion 52 protrudes from the outer surface of the lock cylinder 50. In a preferred embodiment, the door abutting portion 52 is formed, but not limited to, round the axis of the lock cylinder 50. The door abutting portion 52 can also be multiple blocks protruding from the lock cylinder 50, as long as it is capable of abutting against a door A. An annular mounting groove 53 is formed around the outer surface of the lock cylinder 50, and is located between the opening of the keyhole 51 and the door abutting portion 52. In a preferred embodiment, the annular mounting groove 53 is located, but no limited to, next to the door abutting portion 52, and the door abutting portion 52 forms a lateral surface of the annular mounting groove 53, such that the total length of the lock cylinder 50 is reduced; the door abutting portion 52 and the annular mounting groove 53 can also be spaced from one another.

In a preferred embodiment, the lock cylinder 50 comprises a front face section 501 and a mounting section 502. The opening of the keyhole 51, the annular mounting groove 53 and the door abutting portion 52 are located in the front face section 501. An external thread is formed on an outer surface of the mounting section 502, and a nut 60 is screwed into the mounting section 502, such that the door assembly is secured on the door by having a side of the nut 60 and the door abutting portion 52 abut against two opposite sides of the door A respectively. The door assembly can also be secured on the door A by other means, as long as the door abutting portion 52 abuts against the side of the door A.

Figure 1:
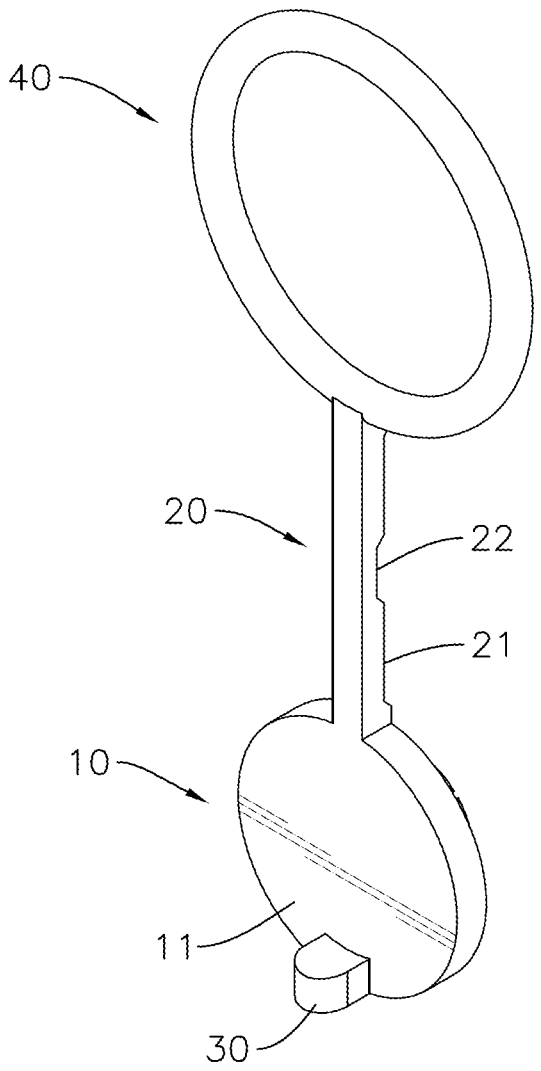
FIG. 1 is a perspective view of a dust cover in accordance with the present invention.
Figure 3:
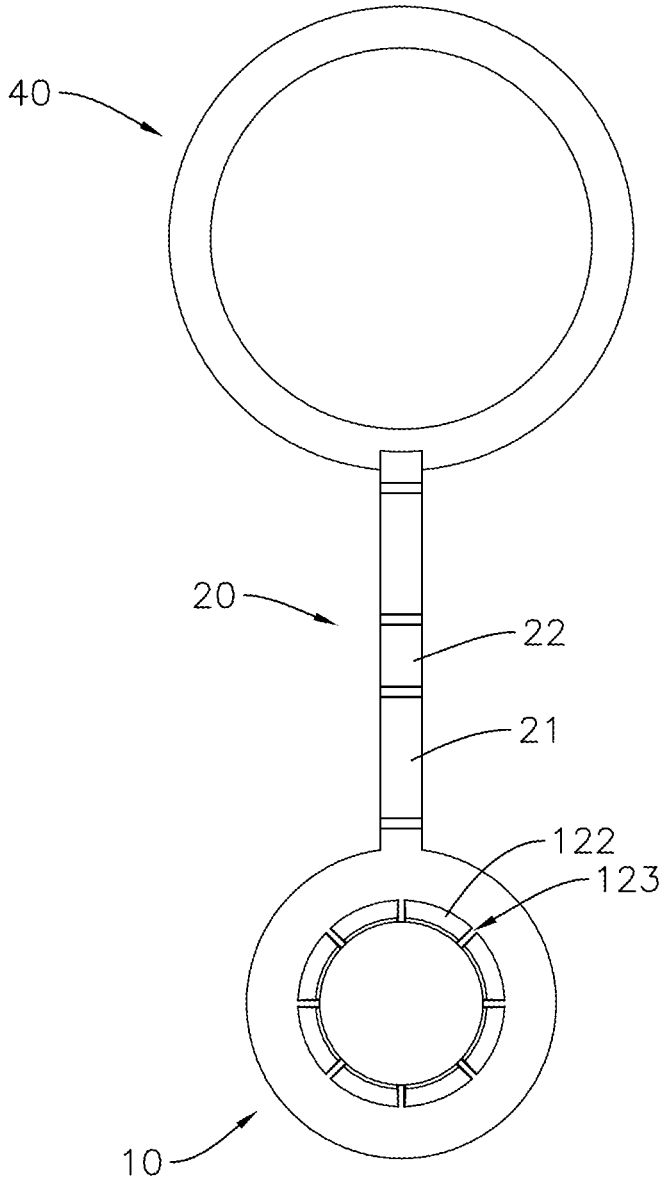
FIG. 3 is a front view of the dust cover in FIG. 1.
Figure 4:
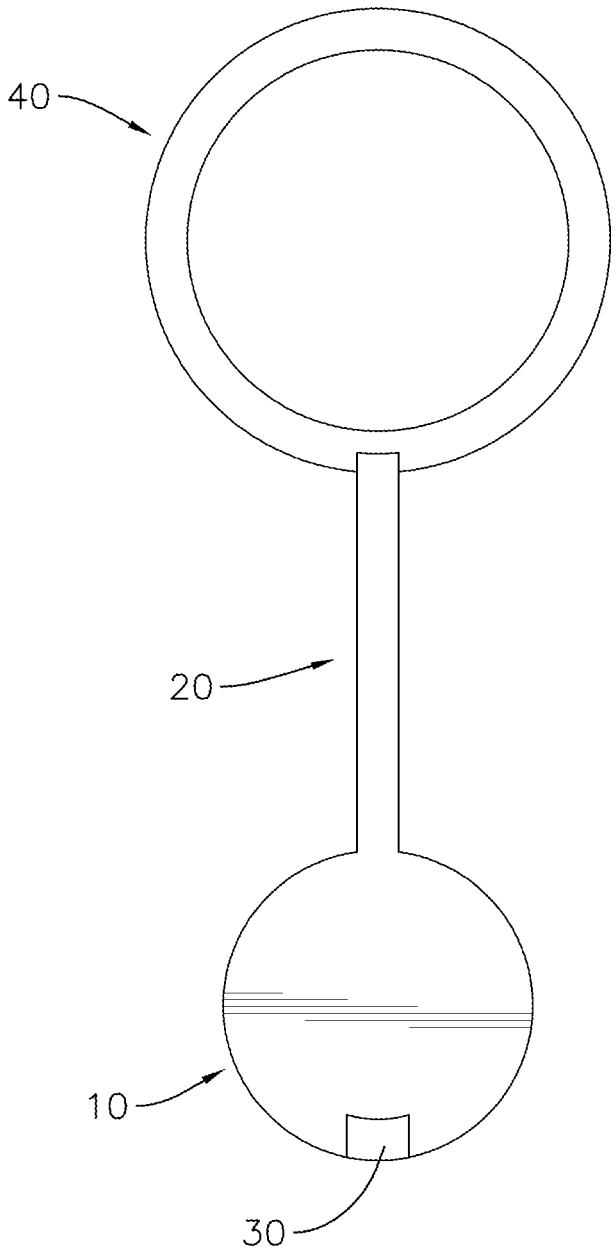
FIG. 4 is a rear view of the dust cover in FIG. 1.

The dust cover is identical to the aforementioned dust cover as shown in FIGS. 1 and 3, and thus the details are not repeated here. A mounting ring 40 of the dust cover is rotatably and annularly mounted in the annular mounting groove 53 of the lock cylinder; the annular insertion wall 12 can be mounted in and engage with the keyhole 51.

With reference to FIG. 8, when the present invention is installed onto a door A, the mounting ring 40 is mounted around the lock cylinder 50 by having the mounting ring deformed to enter the annular mounting groove 53. After the dust cover is connected to the lock cylinder 50, the lock cylinder 50 is secured on the door A using the nut 60. The installation of the dust cover and the lock is then finished. After finishing installing the lock and the dust cover, the cover body 10 can be mounted to and seal the keyhole 51 to prevent foreign objects from entering the lock cylinder 50. When the dust cover is broken due to aging or improper use, the broken dust cover can be replaced with a new dust cover without removing the lock from the door.

With reference to FIG. 7, a second embodiment of the lock assembly in accordance with the present invention is substantially similar to the first embodiment mentioned above, but the difference is that a lock cylinder 50A is a standard tubular lock, a cylinder is mounted in a center of the keyhole 51A, but the cover body 10 of the dust cover can still be mounted to and seal the keyhole 51A.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lock assembly, the lock assembly mounted through a door, and comprising:

a lock comprising a lock cylinder mounted through the door, and having a keyhole formed in one end of the lock cylinder;

an annular mounting groove formed around an outer surface of the lock cylinder;

a door abutting portion protruding from the outer surface of the lock cylinder; the annular mounting groove located between an opening of the keyhole and the door abutting portion; and a nut mounted around and screwed into the lock cylinder, wherein a door mounting groove is formed between the door abutting portion and the nut; the door mounting groove and the annular mounting groove are located on two opposite sides of the door abutting portion respectively; the door is engaged in the door mounting groove and clamped between the door abutting portion and the nut; and a dust cover made of plastic and comprising:

a cover body comprising:

a cover plate;

an annular insertion wall protruding from one of two surfaces of the cover plate;

a connecting portion being elongated and bendable; one of two ends of the connecting portion connected to the cover plate, and comprising a first bending recess formed in a surface of the connecting portion and extending to two opposite sides of the connecting portion; and a mounting ring connected to the other end of the connecting portion; wherein the mounting ring of the dust cover is rotatably mounted around the annular mounting groove of the lock cylinder; the annular insertion wall is selectively mounted in and engages with the keyhole; one of the two surfaces of the cover plate is attached to the lock cylinder when the annular insertion wall is mounted in and engages with the keyhole.

2. The lock assembly as claimed in claim 1, wherein the dust cover further comprises a holding tab; the holding tab protrudes from the other surface of the cover plate, said the other surface being opposite the annular insertion wall.

3. The lock assembly as claimed in claim 2, wherein the holding tab is located on a periphery of the cover plate; the holding tab and the connecting portion are located on two opposite sides of the cover plate respectively.

4. The lock assembly as claimed in claim 3, wherein multiple separation slots are formed in a top of the annular insertion wall; the separation slots extend from the top of the annular insertion wall towards the cover plate; the separation slots are annularly disposed apart from each other.

5. The lock assembly as claimed in claim 4, wherein the annular insertion wall comprises:

an engaging portion formed on the cover plate;

a guiding portion formed on an end of the engaging portion; the thickness of the guiding portion gradually decreasing towards a direction away from the cover plate.

6. The lock assembly as claimed in claim 5, wherein when the connecting portion is straight without bending, an opening of the first bending recess of the connecting portion is open towards a direction in which the annular insertion wall protrudes from the cover plate.

7. The lock assembly as claimed in claim 6, wherein a second bending recess is formed in a bottom of the first bending recess, the second bending recess extends to the two opposite sides of the connecting portion, and an area of the second bending recess is smaller than an area of the first bending recess.

8. The lock assembly as claimed in claim 7, wherein the lock cylinder is a tubular lock cylinder.

9. The lock assembly as claimed in claim 1, wherein multiple separation slots are formed in a top of the annular insertion wall; the separation slots extend from the top of the annular insertion wall towards the cover plate; the separation slots are annularly disposed apart from each other.

10. The lock assembly as claimed in claim 1, wherein the annular insertion wall comprises:

an engaging portion formed on the cover plate;

a guiding portion formed on an end of the engaging portion; the thickness of the guiding portion gradually decreasing towards a direction away from the cover plate.

11. The lock assembly as claimed in claim 1, wherein when the connecting portion is straight without bending, an opening of the first bending recess of the connecting portion is open towards a direction in which the annular insertion wall protrudes from the cover plate.

12. The lock assembly as claimed in claim 1, wherein a second bending recess is formed in a bottom of the first bending recess, the second bending recess extends to the two opposite sides of the connecting portion, and an area of the second bending recess is smaller than an area of the first bending recess.

13. The lock assembly as claimed in claim 1, wherein the door abutting portion forms a lateral surface of the annular mounting groove.

14. The lock assembly as claimed in claim 1, wherein the lock cylinder is a tubular lock cylinder.

* * * * *